US010563643B2

(12) United States Patent
Wang

(10) Patent No.: US 10,563,643 B2
(45) Date of Patent: Feb. 18, 2020

(54) HAND PUMP WITH DETACHABLE AIR STORAGE TANK

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Taichung (TW)

( * ) Notice: Subject to any disclaimer, the term of this patent is extended or adjusted under 35 U.S.C. 154(b) by 311 days.

(21) Appl. No.: 15/602,140

(22) Filed: May 23, 2017

(65) Prior Publication Data

US 2018/0340528 A1 Nov. 29, 2018

(51) Int. Cl.

| | |
|---|---|
| ***F04B 33/00*** | (2006.01) |
| ***F04B 41/02*** | (2006.01) |
| ***F04B 53/10*** | (2006.01) |
| ***F04B 51/00*** | (2006.01) |
| ***F04B 53/22*** | (2006.01) |
| ***F04B 39/14*** | (2006.01) |
| ***F04B 49/22*** | (2006.01) |
| ***F04B 39/12*** | (2006.01) |

(52) U.S. Cl.

CPC ..... *F04B 33/00* (2013.01); *F04B 33/005* (2013.01); *F04B 39/123* (2013.01); *F04B 39/14* (2013.01); *F04B 41/02* (2013.01); *F04B 49/22* (2013.01); *F04B 51/00* (2013.01); *F04B 53/10* (2013.01); *F04B 53/22* (2013.01); *F04B 2205/05* (2013.01)

(58) Field of Classification Search

CPC ..... F04B 41/02; F04B 51/00; F04B 33/00; F04B 39/0022; F04B 53/10; F04B 33/005; F04B 35/06; F04B 39/14; F04B 53/121; F04B 53/143; F04B 53/162; F04B 53/22

USPC ..... 417/63, 234

See application file for complete search history.

(56) References Cited

U.S. PATENT DOCUMENTS

| | | | | |
|---|---|---|---|---|
| 5,590,696 | A | 1/1997 | Phillips et al. | |
| 6,652,242 | B2 | 11/2003 | Wu | |
| 6,676,390 | B2 * | 1/2004 | Wang | F04B 33/00 417/468 |
| 6,883,565 | B2 | 4/2005 | Marui | |
| 8,721,296 | B1 * | 5/2014 | Wang | F04B 33/005 137/565.15 |
| 10,184,466 | B2 * | 1/2019 | Wu | F04B 39/10 |

* cited by examiner

*Primary Examiner* — Essama Omgba
*Assistant Examiner* — Stephen A Mick
(74) *Attorney, Agent, or Firm* — Charles E. Baxley

(57) ABSTRACT

A hand pump includes a receptacle extended upwardly from a base, a piston slidably engaged in the receptacle for generating a pressurized air, a check valve engaged between the receptacle and a tubular member for limiting the flow of the pressurized air, a cover attached to the receptacle and having an arm, a manifold having an inlet port connected to the tubular member for receiving the pressurized air from the tubular member, the manifold includes a stud engaged through the hole of the arm, a pressure gauge is connected to the manifold for displaying a pressure in the manifold, and a hose is coupled to the stud of the manifold for receiving the pressurized air from the manifold, and a nozzle is attached to the hose.

10 Claims, 10 Drawing Sheets

HAND PUMP WITH DETACHABLE AIR STORAGE TANK

BACKGROUND OF THE INVENTION

1. Field of the Invention

The present invention relates to a hand pump or air pump for inflating the inflatable tires or objects or the like of the cycles, such as the bicycles, and more particularly to a hand pump or air pump for a bicycle including a detachable air storage tank for storing the pressurized air and including a control valve device for controlling the outward supplying of the pressurized air through a nozzle and for allowing the pressurized air to be easily controlled and operated or supplied out to inflate the inflatable tires or objects or the like.

2. Description of the Prior Art

Typical hand pumps or air pumps or manual pumps comprise a tubular or cylindrical housing including a stand attached or mounted or secured to the bottom portion thereof for supporting the tubular or cylindrical housing in or at an upright status, and a handle attached or mounted or secured to the upper portion thereof for actuating or operating the piston to move in a reciprocating action within the tubular or cylindrical housing in order to pump and to generate the pressurized air and to supply the pressurized air out of the tubular or cylindrical housing.

For example, U.S. Pat. No. 5,590,696 to Phillips et al., U.S. Pat. No. 6,652,242 to Wu, U.S. Pat. No. 6,676,390 to Wang, U.S. Pat. No. 6,883,565 to Marui, and U.S. Pat. No. 8,721,296 to Wang disclose several of the typical hand pumps or air pumps or manual pumps for the bicycles each comprising a tubular or cylindrical housing including a bottom stand and an upper handle, and an air storage tank coupled to and communicating with the tubular or cylindrical housing for receiving and storing the pressurized air from the tubular or cylindrical housing of the manual pump and for selectively supplying the pressurized air to inflate the inflatable tires or objects or the like.

However, the pressurized air may not be easily actuated or operated or controlled by the user to supply the pressurized air out to inflate the inflatable tires or objects or the like, and may not be easily and quickly switched to supply the pressurized air to inflate the inflatable tires or objects or the like directly with the typical hand pumps or air pumps or manual pumps or with the air storage tank.

The present invention has arisen to mitigate and/or obviate the afore-described disadvantages of the conventional hand pumps or air pumps or manual pumps and the air storage tank combinations or assemblies.

SUMMARY OF THE INVENTION

The primary objective of the present invention is to provide a hand pump or air pump for a bicycle including a detachable air storage tank for storing the pressurized air and having a control valve device for controlling the outward supplying of the pressurized air through a nozzle and for allowing the pressurized air to be easily controlled and operated or supplied out to inflate the inflatable tires or objects or the like.

In accordance with one aspect of the invention, there is provided a hand pump comprising a base including a receptacle extended upwardly from the base, and the receptacle including a compartment formed therein, and the receptacle including a bottom portion, a cover attached to an upper portion of the receptacle, the cover including an arm, and a hole formed in the arm, a piston slidably engaged in the compartment of the receptacle, a piston rod attached to the piston, and a handle attached to the piston rod for moving the piston along the receptacle in a reciprocating action in order to generate a pressurized air within the compartment of the receptacle, a tubular member, a check valve engaged between the receptacle and the tubular member for guiding and limiting the pressurized air to flow only from the receptacle into the tubular member and for preventing the pressurized air from flowing backward from the tubular member into the compartment of the receptacle, a manifold including an inlet port connected to the tubular member for receiving the pressurized air from the tubular member, the manifold including a stud, and the stud of the manifold being engaged through the hole of the arm, a pressure gauge is connected to the manifold for displaying a pressure in the manifold, and a hose is coupled to the stud of the manifold for receiving the pressurized air from the manifold, and a nozzle is attached to the hose for supplying the pressurized air to inflate the inflatable facilities or devices or the like.

The cover includes a bore for slidably engaging with the piston rod. The receptacle includes a passage formed in the bottom portion of the receptacle and communicating with the compartment of the receptacle, a gasket is engaged into the compartment of the receptacle and includes an orifice formed in the gasket and aligned with the passage of the receptacle for engaging with the check valve.

A control valve device may further be provided and includes a barrel connected to the manifold, the barrel includes a chamber formed within the barrel for receiving the pressurized air from the manifold, the barrel includes a first outlet port and a second outlet port communicating with the chamber of the barrel, the pressure gauge is connected to the first outlet port of the barrel for displaying a pressure in the chamber of the barrel, the hose is coupled to the second outlet port of the barrel for receiving the pressurized air from the barrel, a nozzle is attached to the hose, and a valve member is slidably received and engaged in the chamber of the barrel, the valve member includes a pathway communicating with the chamber of the barrel for aligning with and for offsetting from the second outlet port of the barrel selectively, and for controlling the pressurized air to flow from the chamber of the barrel into the second outlet port of the barrel.

The control valve device includes an air storage tank having a mouth connected to the barrel and communicating with the chamber of the barrel for allowing the pressurized air to flow into and out of the air storage tank and to flow between the barrel and the air storage tank selectively. The barrel includes a mouth engaged with the stud of the manifold.

The control valve device includes a spring biasing member disposed in the chamber of the barrel and engaged with the valve member for biasing and forcing the valve member to move relative to the barrel. The control valve device includes an actuating shank having a cam member for engaging with the valve member and for moving the valve member relative to the barrel selectively to control the flowing of the pressurized air.

The control valve device includes a housing attached to the barrel, and the housing includes a bore formed in the housing and communicating with the chamber of the barrel for rotatably receiving the actuating shank. The housing is formed integral with barrel and perpendicular to the barrel.

The control valve device includes a hand grip attached to the actuating shank for rotating the actuating shank relative to the housing and for controlling the valve member to move relative to the barrel selectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
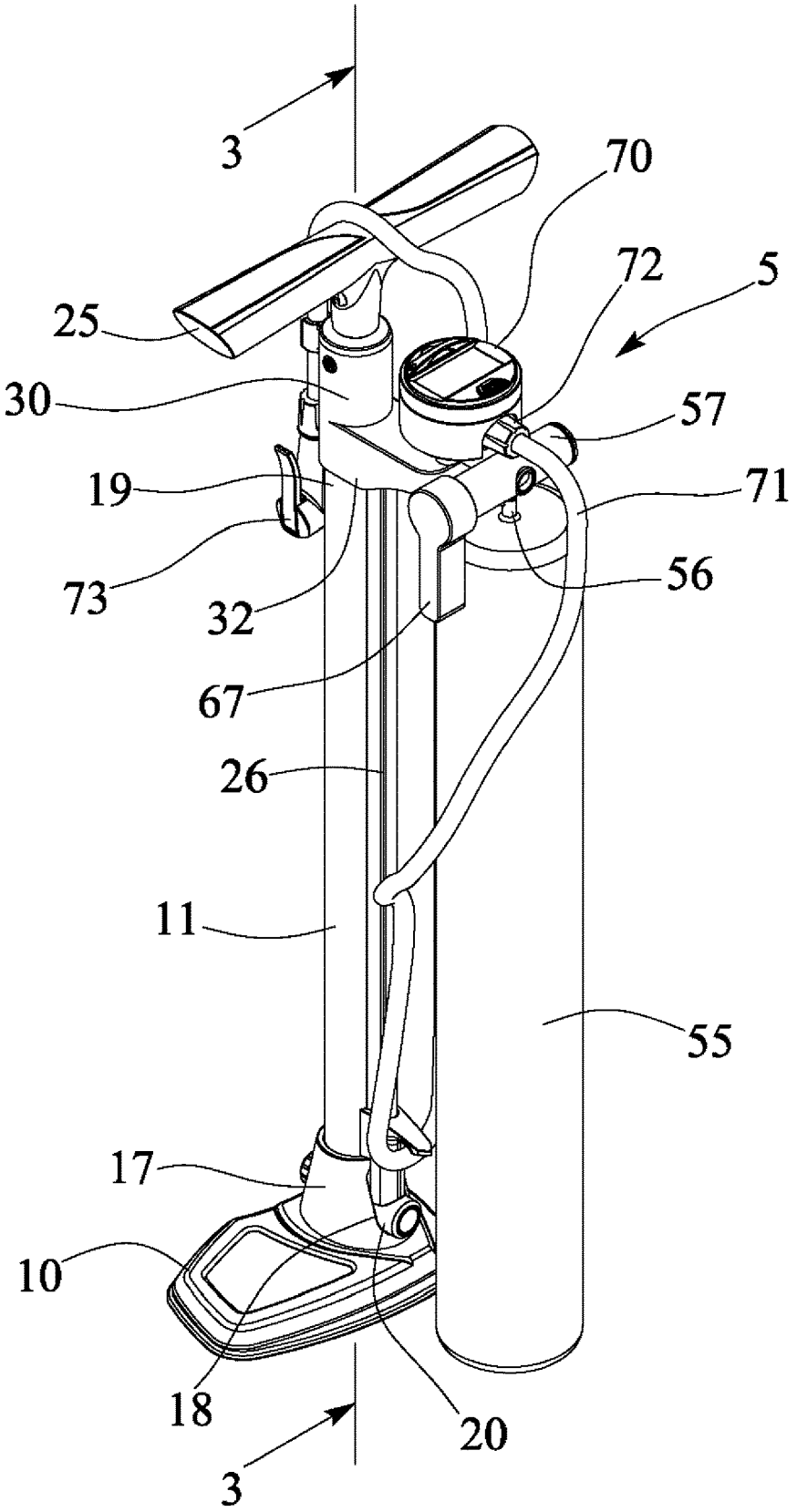
FIG. 1 is a perspective view of a hand pump or air pump in accordance with the present invention.
Figure 2:
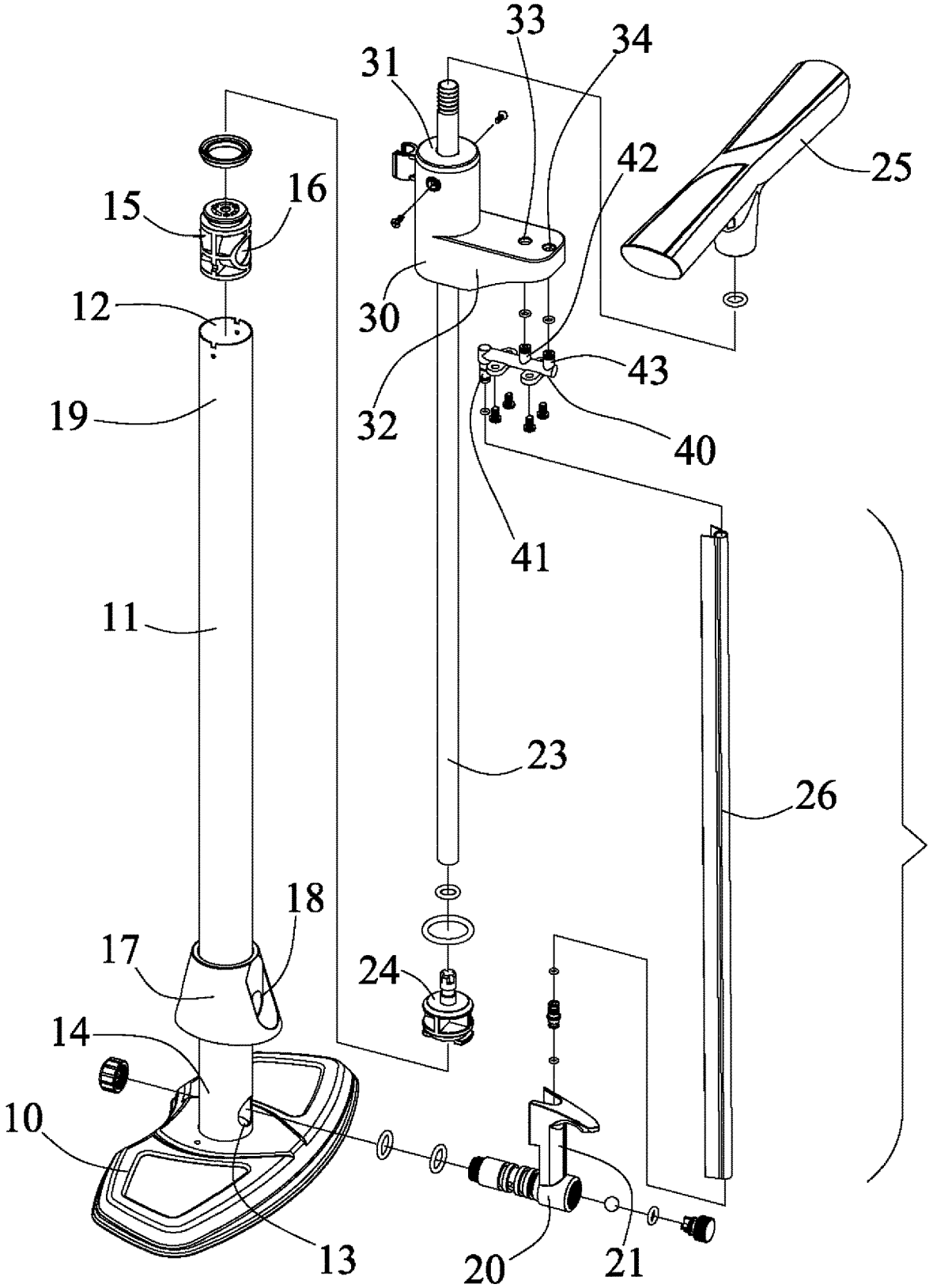
FIG. 2 is a partial exploded view of the hand pump or air pump.
Figure 3:
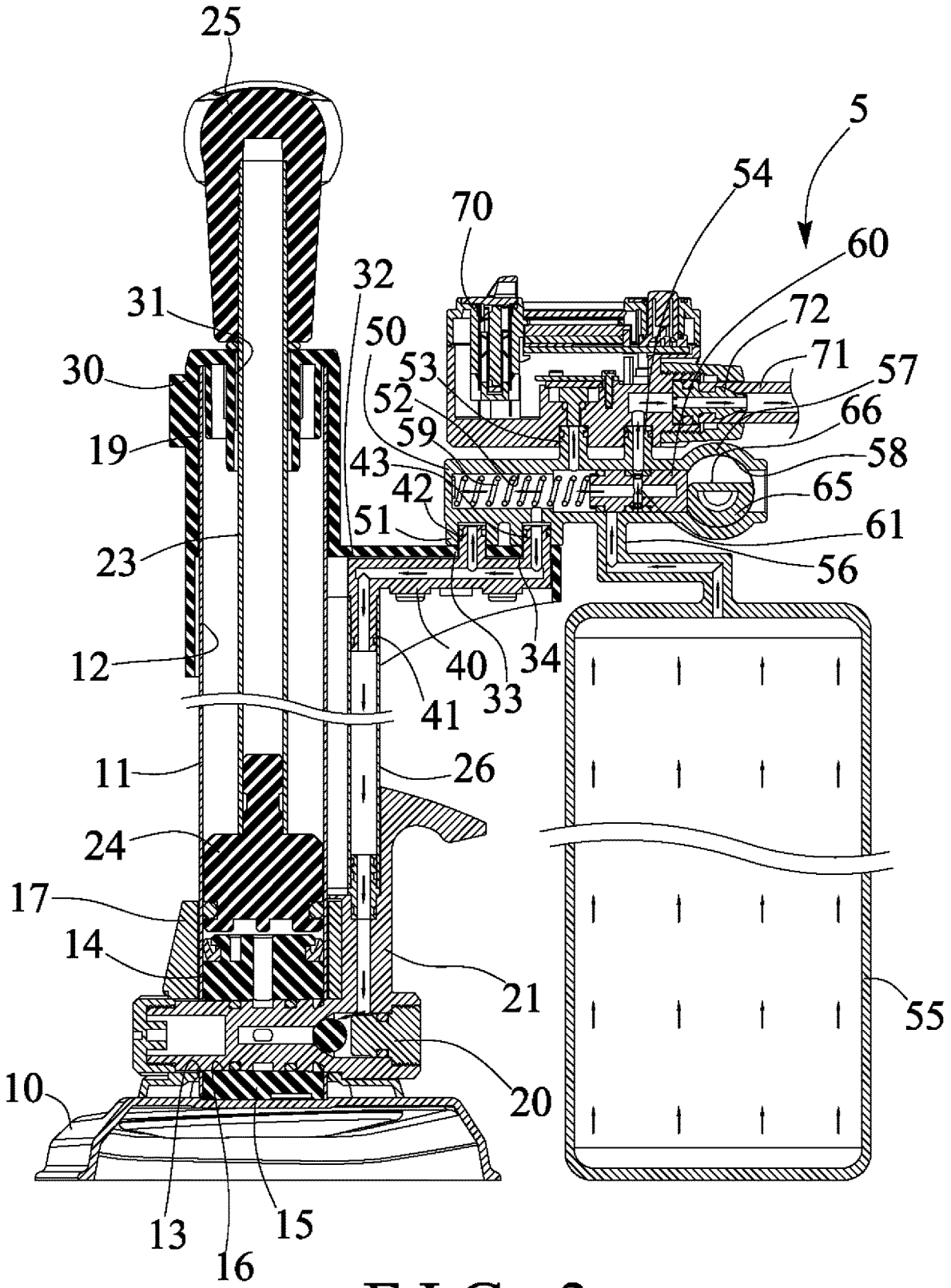
FIG. 3 is a cross sectional view of the hand pump or air pump, taken along lines 3-3 of FIG. 1.

Referring to the drawings, and initially to FIGS. 1-3, a hand pump or air pump in accordance with the present invention comprises a stand or base 10 including a cylindrical or tubular housing or member or receptacle 11 extended upwardly from the base 10, and the receptacle 11 includes a chamber or compartment 12 formed therein (FIGS. 2-4), and an orifice or passage 13 formed in the lower or bottom portion 14 of the receptacle 11 or of the base 10 and communicating with the compartment 12 of the receptacle 11. A plug or gasket 15 is disposed or engaged into the compartment 12 of the receptacle 11 at the lower or bottom portion 14 of the receptacle 11 and includes a passage or orifice 16 formed therein and aligned with or communicating with the passage 13 of the receptacle 11, and a control valve or check valve 20 is disposed or attached or mounted or engaged into the passage 13 of the receptacle 11 and the orifice 16 of the gasket 15.

A hood or cap 17 is attached or mounted or secured to the lower or bottom portion 14 of the receptacle 11 and includes an aperture 18 formed therein (FIG. 2) and aligned with or communicating with the passage 13 of the receptacle 11 for receiving or engaging with the check valve 20, and the check valve 20 includes an extension 21 formed or provided thereon or extended therefrom. Another hood or cover 30 is attached or mounted or secured to the upper portion 19 of the receptacle 11, and includes an aperture or bore 31 formed therein and communicating with the passage 13 of the receptacle 11 for slidably receiving or engaging with a piston rod 23. A piston 24 is attached or mounted or secured to the lower or bottom portion of the piston rod 23 and slidably received or engaged in the compartment 12 of the receptacle 11, and a hand grip or handle 25 is attached or mounted or secured to the upper portion of the piston rod 23.

Figure 4:
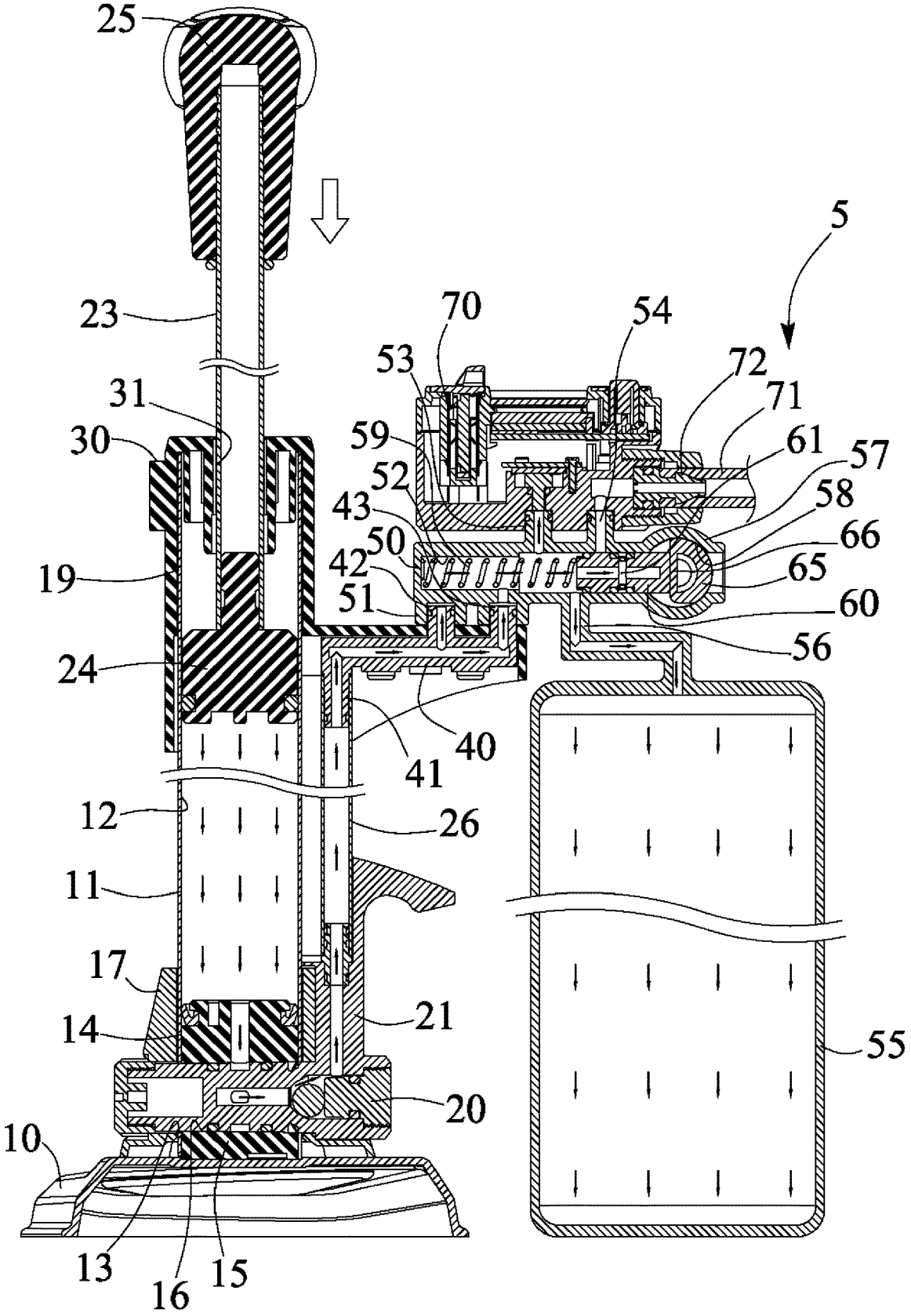
FIG. 4 is another cross sectional view of the hand pump or air pump, similar to FIG. 3, illustrating the operation of the hand pump or air pump.

In operation, as shown in FIGS. 3-4, the piston 24 nay be actuated or operated or moved relative to and/or along the receptacle 11 in a reciprocating action, within the compartment 12 of the receptacle 11 in order to pump and to generate the pressurized air and to supply the pressurized air toward and through the check valve 20. A tubular member 26 is attached or mounted or secured to the extension 21 of the check valve 20, or directly connected or coupled to the lower or bottom portion 14 of the receptacle 11, and/or the check valve 20 is coupled or engaged between the receptacle 11 and the tubular member 26 for guiding and limiting the pressurized air to flow only from the receptacle 11 into the tubular member 26, and for preventing the pressurized air from flowing backward from the tubular member 26 into the compartment 12 of the receptacle 11. As shown in FIGS. 2-4, the cover 30 includes an extension or arm 32 formed or provided thereon or extended therefrom, and having one or more (such as two) holes 33, 34 formed in the arm 32.

A piping mechanism or manifold 40 is received or engaged into the arm 32, and includes an inlet port 41 connected or coupled to the tubular member 26 for receiving the pressurized air from the tubular member 26, and includes one or more (such as two) ports or studs 42, 43 formed or provided thereon or extended therefrom and engaged through the holes 33, 34 of the arm 32 for allowing the manifold 40 to be anchored or retained or positioned to the arm 32 of the cover 30, and arranged for allowing the pressurized air to flow out through either or both of the studs 42, 43 of the manifold 40. The manifold 40 may further be solidly and stably attached or mounted or secured to the arm 32 or the cover 30 with welders or adhesive materials or the like, or with screws or bolts or catches or latches or fasteners (not illustrated) or the like for preventing the manifold 40 from being disengaged or separated from the arm 32 or the cover 30.

As shown in FIGS. 1, 3-4 and 8, a control valve device 5 includes another tubular member or barrel 50 having one or more (such as two) ports or mouths 51 formed or provided thereon or extended therefrom and engaged with the studs 42, 43 of the manifold 40 for connecting or coupling to the studs 42, 43 of the manifold 40 with welders or adhesive materials or the like, or with screws or bolts or catches or latches or fasteners (not illustrated) or the like and for receiving the pressurized air from the manifold 40 and the tubular member 26, and includes a compartment or chamber 52 formed within the barrel 50, the chamber 52 of the barrel 50 is communicating with either or both of the mouths 51 and/or the studs 42, 43 of the manifold 40 for receiving the pressurized air from the manifold 40. The barrel 50 further includes one or more (such as two) mouths or outlet ports 53, 54 formed or provided thereon or extended therefrom, and communicating with the chamber 52 of the barrel 50 for allowing the pressurized air to flow out through either or both of the outlet ports 53, 54 of the barrel 50. Alternatively, the barrel 50 may also be directly connected or coupled to the tubular member 26 without the manifold 40.

Figure 5:
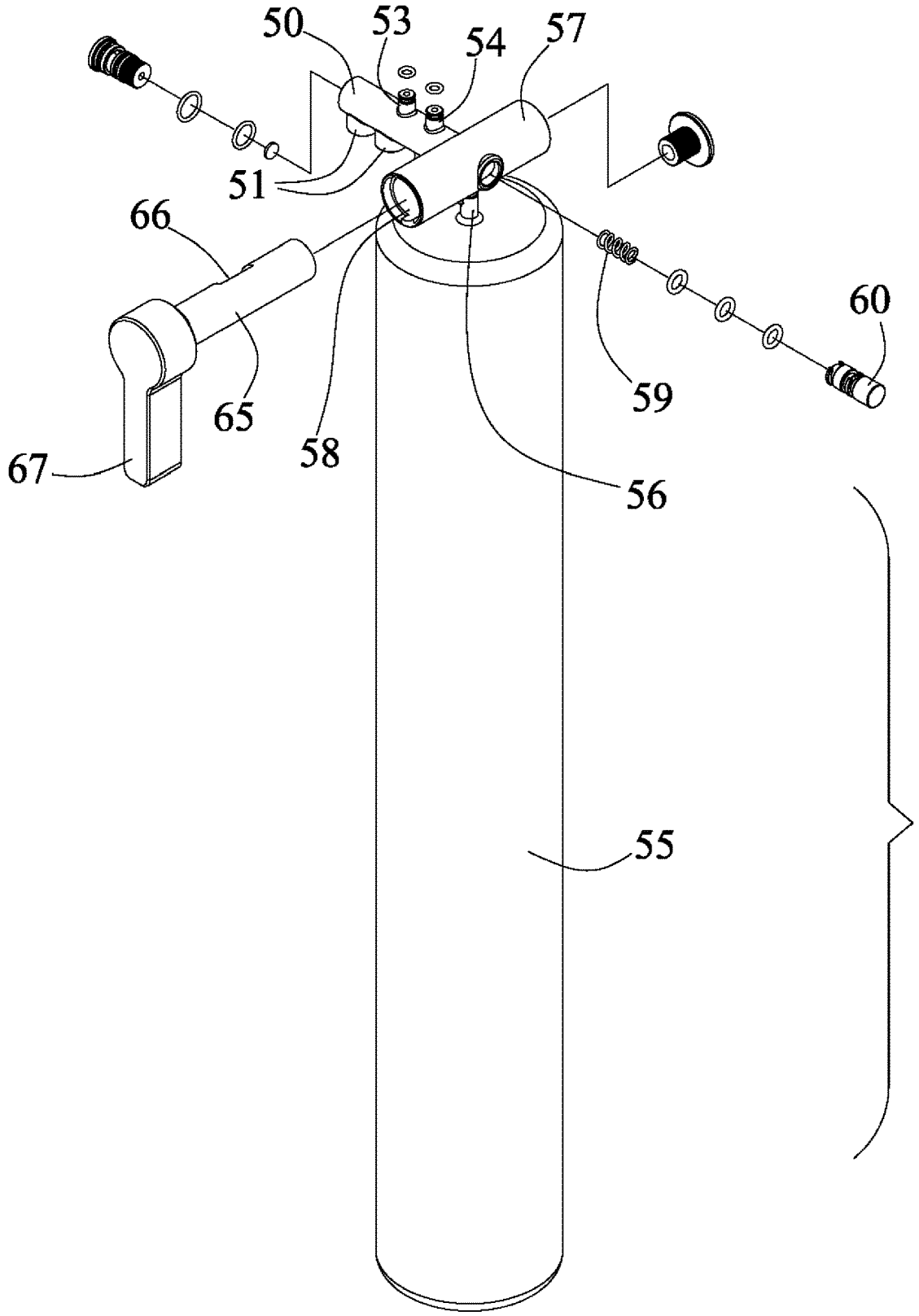
FIG. 5 is another partial exploded view of the hand pump or air pump.

An air storage tank 55 includes a mouth 56 formed or provided thereon or extended therefrom and engaged with or connected or coupled to the barrel 50 and communicating with the chamber 52 of the barrel 50 for allowing the pressurized air to flow into or out of the air storage tank 55 (FIGS. 3, 4) and to flow between the barrel 50 and the air storage tank 55 selectively. A switch or valve piece or valve member 60 is slidably received or engaged in the chamber 52 of the barrel 50 for controlling the pressurized air to flow from the chamber 52 of the barrel 50 into either the air storage tank 55 (FIG. 4) or the second outlet port 54 of the barrel 50 (FIG. 5). For example, the valve member 60 includes a manifold or pathway 61 formed therein and communicating with the chamber 52 of the barrel 50 for aligning with or communicating with the second outlet port 54 of the barrel 50 (FIG. 3) or offset from the second outlet port 54 of the barrel 50 (FIG. 4) selectively. A spring biasing member 59 is disposed in the chamber 52 of the barrel 50 and engaged with the valve member 60 for biasing and forcing the valve member 60 to move relative to the barrel 50.

The control valve device 5 further includes another barrel or housing 57 attached or mounted to the barrel 50 or formed integral with barrel 50, and disposed or arranged substantially perpendicular to the barrel 50, and the housing 57 includes an aperture or bore 58 formed therein and communicating with the chamber 52 of the barrel 50 for pivotally or rotatably receiving or engaging with a valve stem or actuating shank 65 which includes a cam member 66 for selectively contacting or engaging with the valve member 60 and for moving the valve member 60 relative to the barrel 50 to offset the pathway 61 of the valve member 60 from the outlet port 54 of the barrel 50 (FIG. 4) selectively. A knob or hand grip 67 is attached or mounted or secured to the actuating shank 65 for pivoting or rotating the actuating shank 65 relative to the housing 57, and for controlling or moving the valve member 60 relative to the barrel 50 selectively.

Figure 6:
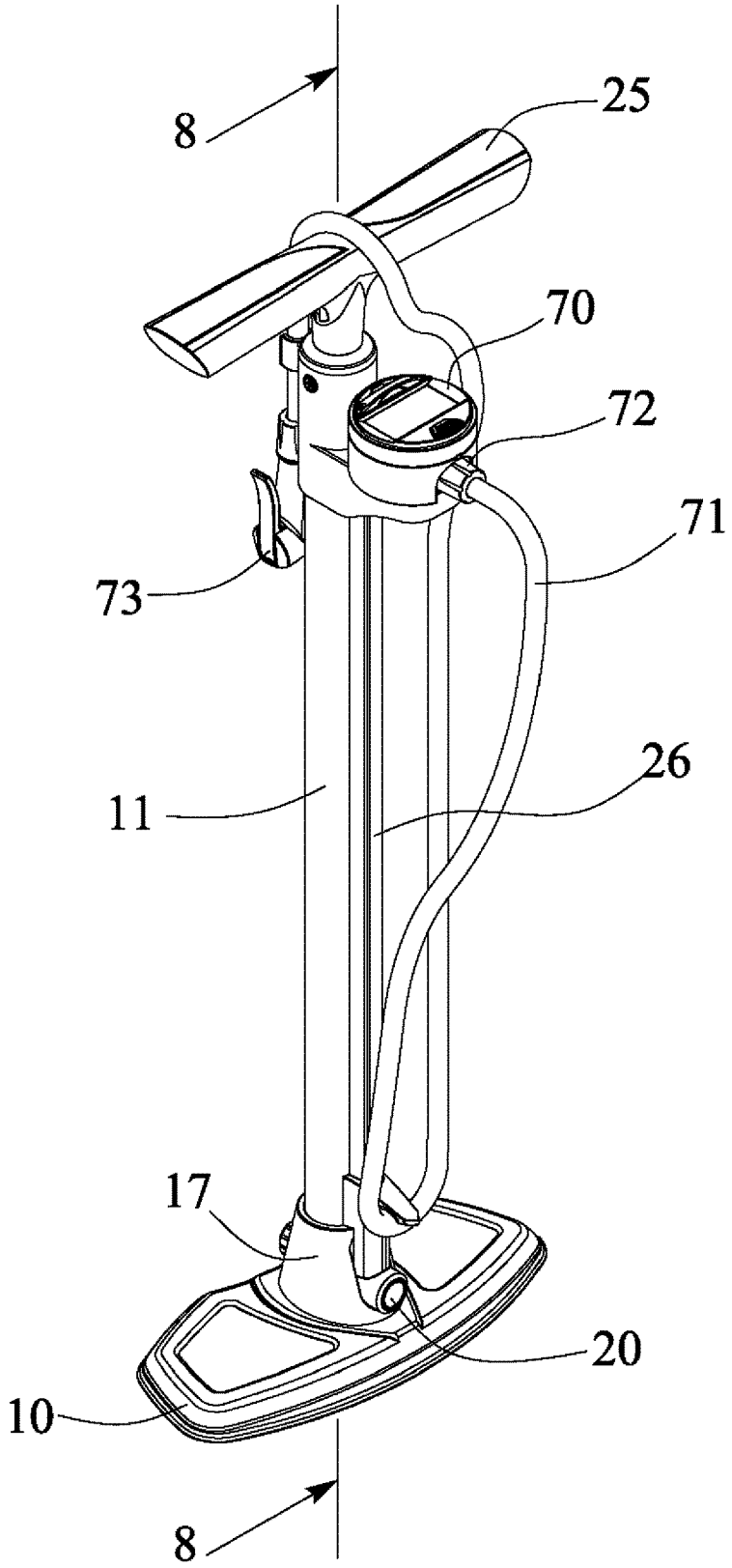
FIGS. 6, 7 are partial perspective views of the hand pump or air pump.
Figure 7:
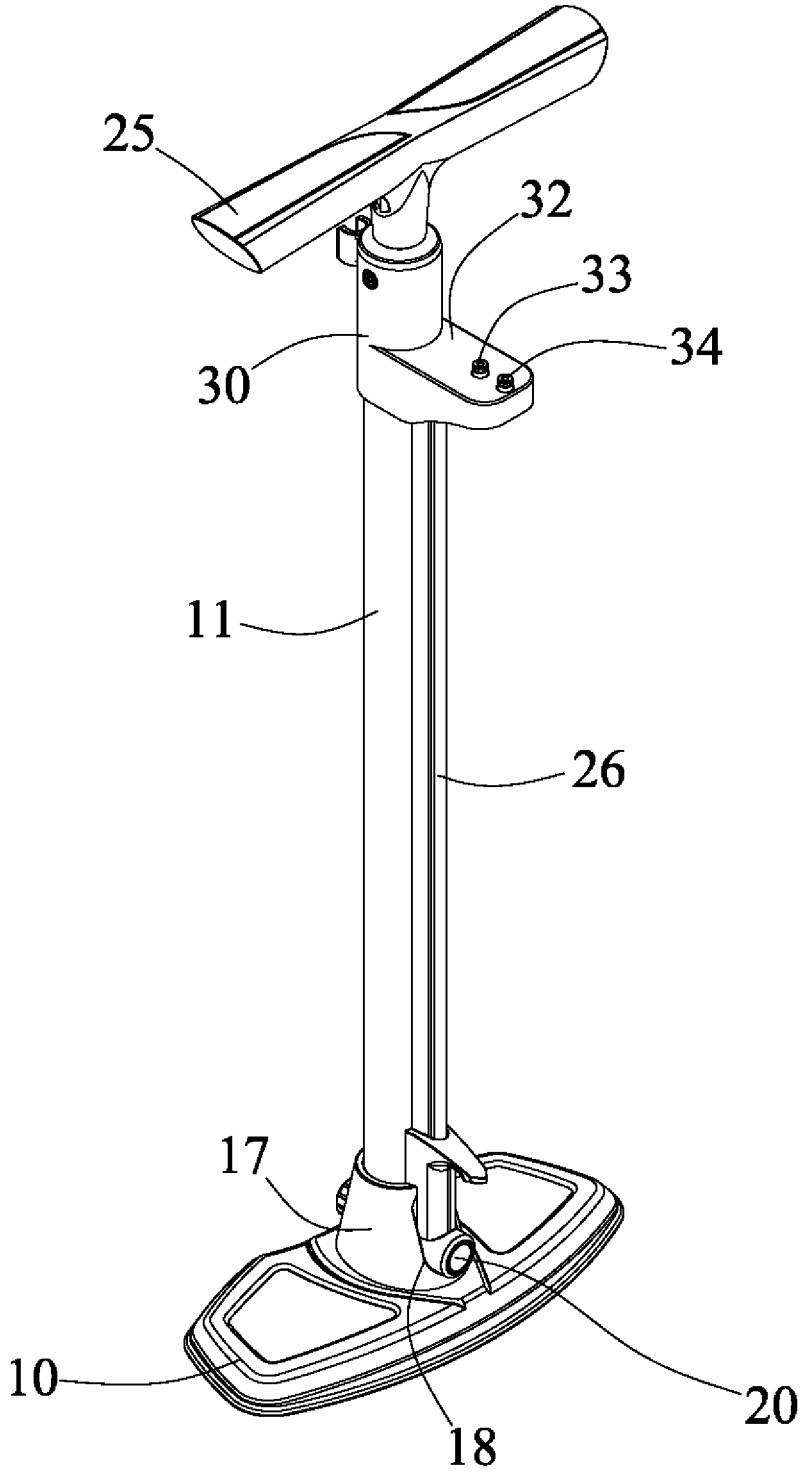
Figure 8:
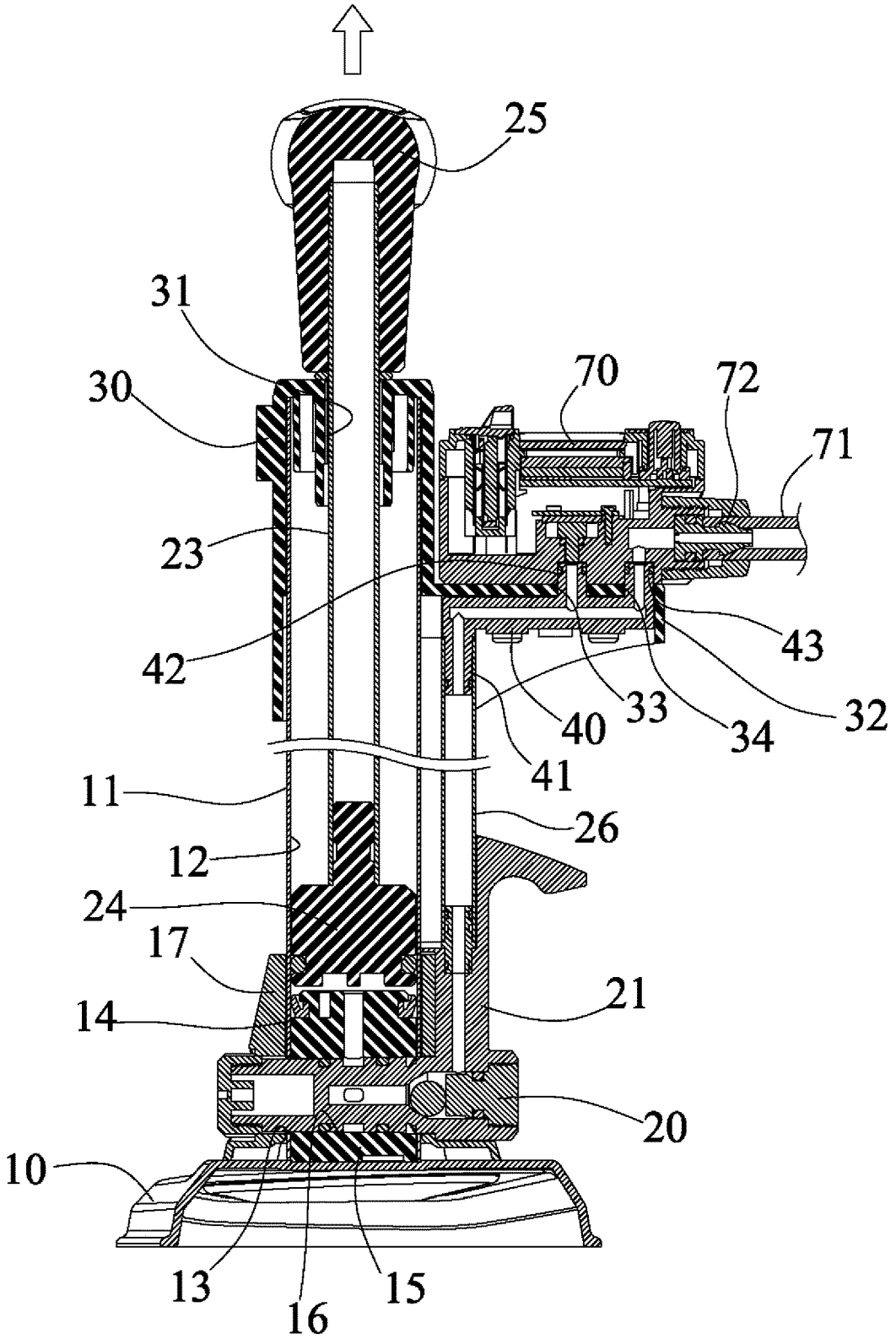
FIG. 8 is a further cross sectional view of the hand pump or air pump, taken along lines 8-8 of FIG. 6.

A pressure gauge 70 is attached or mounted or secured to the barrel 50 and/or connected or coupled to one of the outlet ports 53 or the first outlet port 53 of the barrel 50 for receiving the pressurized air from the barrel 50 (FIGS. 3-4) and for sensing and showing or displaying the pressure in the chamber 52 of the barrel 50. A hose 71 includes one or first end portion 72 engaged with or connected or coupled to the other outlet port 54 of the barrel 50 for allowing the pressurized air to flow into the hose 71 selectively, and includes a mouth or nozzle 73 (FIGS. 1, 6) attached or mounted or secured to the other or second end portion thereof for engaging with various kinds of air inflatable facilities or devices (not illustrated) and for filling or supplying the pressurized air to inflate the inflatable facilities or devices.

In operation, as shown in FIG. 4, the actuating shank 65 may be actuated or operated and pivoted or rotated relative to the housing 57 with the hand grip 67 in order to control and to move the valve member 60 relative to the barrel 50 and so as to offset the pathway 61 of the valve member 60 from the outlet port 54 of the barrel 50 selectively. At this moment, and/or when the piston 24 is actuated or operated or moved relative to the receptacle 11 to generate the pressurized air and to supply the pressurized air toward and through the tubular member 26 and the manifold 40 and then into the chamber 52 of the barrel 50, and then into the air storage tank 55 for allowing the pressurized air to be contained and stored within the air storage tank 55 selectively. At this moment, the outlet port 54 of the barrel 50 is blocked and sealed by the valve member 60 such that the pressurized air may not flow into the hose 71.

As shown in FIG. 3, the valve member 60 may be actuated or operated and moved relative to the barrel 50 with the actuating shank 65 selectively in order to control and align the pathway 61 of the valve member 60 with the outlet port 54 of the barrel 50, and the arrangement of the grooves 62 and the notches 64 of the valve member 60 allows the pressurized air to flow from the air storage tank 55 through the outlet port 54 of the barrel 50 and then into the hose 71, in order to inflate the inflatable facilities or devices (not illustrated). As also shown in FIG. 3, when the pathway 61 of the valve member 60 is aligned with the outlet port 54 of the barrel 50, the piston 24 may also be actuated or operated to generate the pressurized air and to supply the pressurized air through the tubular member 26 and the manifold 40 and then into the chamber 52 of the barrel 50, and then into the outlet port 54 of the barrel 50 and the hose 71, in order to inflate the inflatable facilities or devices directly, when the air storage tank 55 is either empty or filled with the pressurized air.

As shown in FIGS. 6-9, when the barrel 50 and the valve member 60 and the air storage tank 55 are removed or disengaged from the cover 30 and/or the receptacle 11, the pressure gauge 70 may be directly attached or mounted or secured to the manifold 40 and/or connected or coupled to one of the studs 42 or the first stud 42 of the manifold 40 for receiving the pressurized air from the manifold 40 (FIGS. 8-9) and for sensing and showing or displaying the pressure in the manifold 40. The one or first end portion 72 of the hose 71 may be directly engaged with or connected or coupled to the other stud 43 of the manifold 40 for allowing the pressurized air to flow into the hose 71 selectively, and includes a mouth or nozzle 73 (FIGS. 1, 6) attached or mounted or secured to the other or second end portion thereof for engaging with various kinds of air inflatable facilities or devices (not illustrated) and for filling or supplying the pressurized air to inflate the inflatable facilities or devices.

Figure 9:
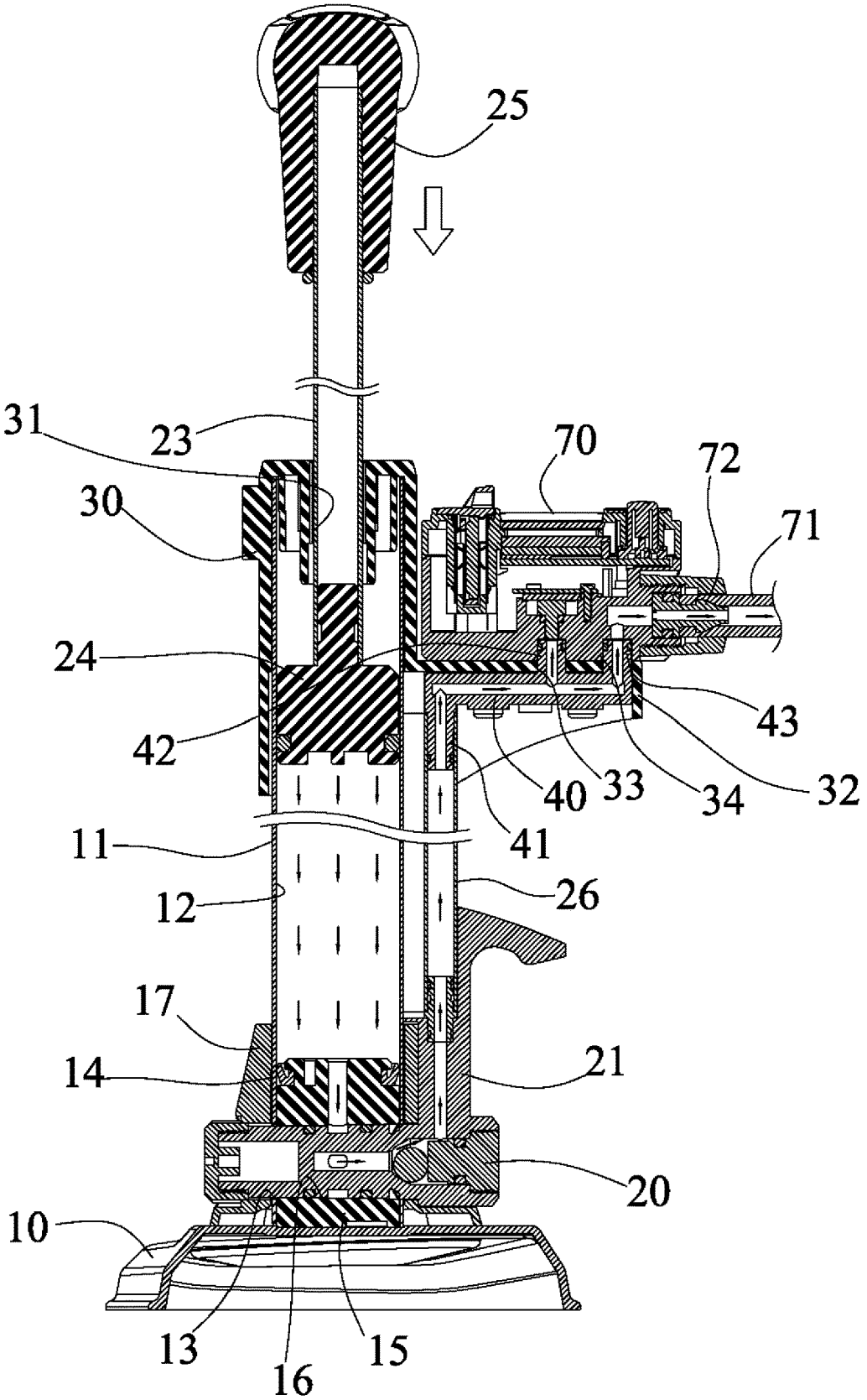
FIGS. 9, 10 are still further cross sectional views similar to FIG. 8, illustrating the operation of the hand pump or air pump.
Figure 10:
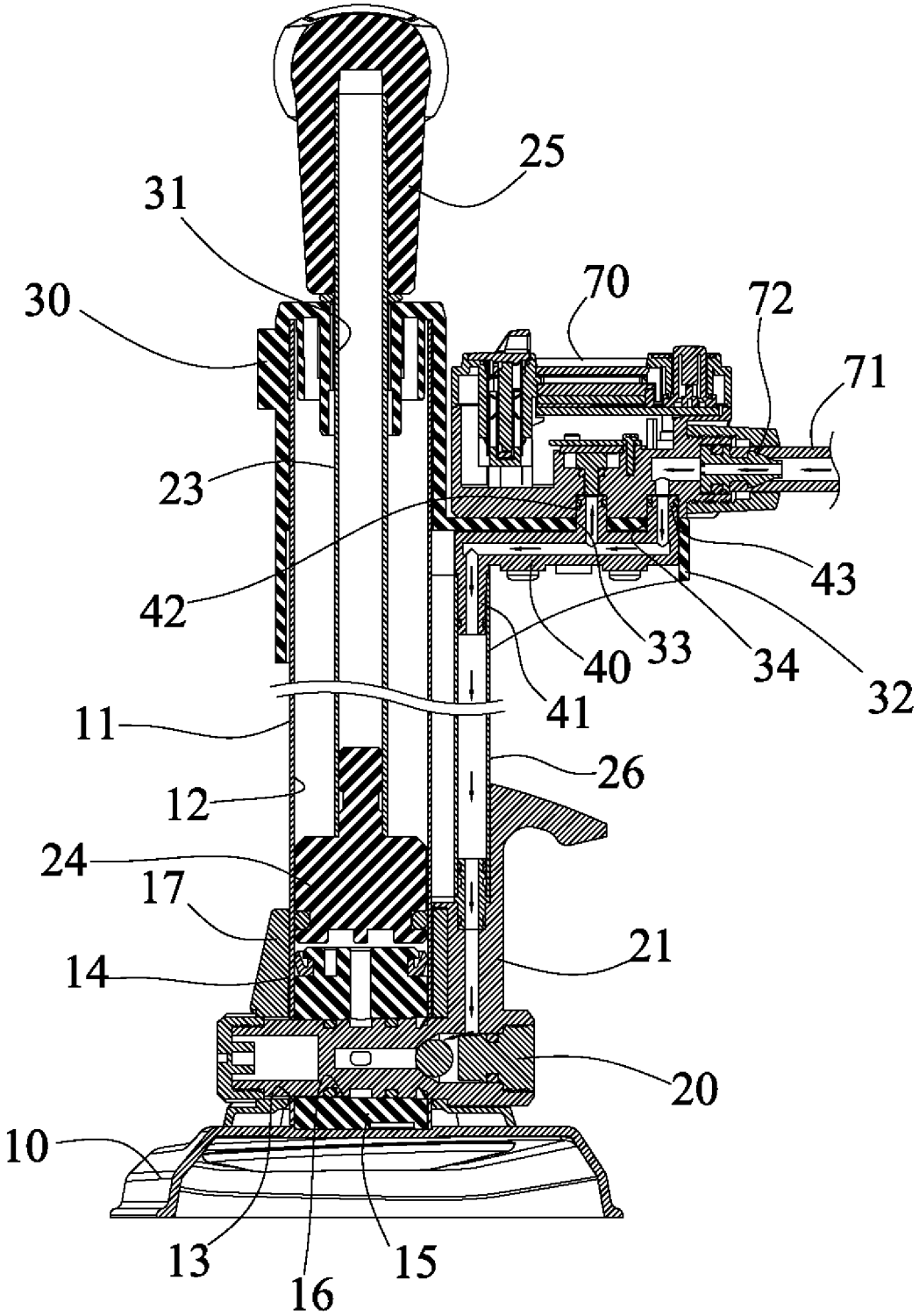

In operation, as shown in FIG. 9, when the piston 24 is actuated or operated or moved relative to the receptacle 11 to generate the pressurized air and to supply the pressurized air toward and through the tubular member 26 and the manifold 40 for allowing the pressurized air to directly flow out through the hose 71. It is preferable that the barrel 50 and the valve member 60 and the air storage tank 55 may be arranged to be easily and quickly and readily removed or disengaged from the cover 30 and/or the receptacle 11, and the pressure gauge 70 may be arranged to be easily and quickly and readily and directly attached or mounted or secured to the manifold 40 and/or connected or coupled to one of the studs 42 or the first stud 42 of the manifold 40, and the one or first end portion 72 of the hose 71 may be arranged to be directly and easily and quickly and readily engaged with or connected or coupled to the other stud 43 of the manifold 40. Similarly, the barrel 50 and the valve member 60 and the air storage tank 55 may also be arranged to be easily and quickly and readily attached or engaged with the cover 30 and/or the receptacle 11 when required.

Accordingly, the hand pump or air pump in accordance with the present invention includes a detachable air storage tank for storing the pressurized air and having a control valve device for controlling the outward supplying of the pressurized air through a nozzle and for allowing the pressurized air to be easily controlled and operated or supplied out to inflate the inflatable tires or objects or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand pump comprising:

a base including a receptacle extended upwardly from said base, and said receptacle including a compartment formed therein, and said receptacle including a bottom portion;

a cover attached to an upper portion of said receptacle, said cover including an arm, and a hole formed in said arm;

a piston slidably engaged in said compartment of said receptacle, a piston rod attached to said piston, and a handle attached to said piston rod for moving said piston along said receptacle in a reciprocating action in order to generate a pressurized air within said compartment of said receptacle;

a tubular member;

a check valve engaged between said receptacle and said tubular member for guiding and limiting the pressurized air to flow only from said receptacle into said tubular member and for preventing the pressurized air from flowing backward from said tubular member into said compartment of said receptacle;

a manifold including an inlet port connected to said tubular member for receiving the pressurized air from said tubular member, said manifold including a stud, and said stud of said manifold being engaged through said hole of said arm;

a pressure gauge connected to said manifold for displaying a pressure in said manifold;

a hose coupled to said stud of said manifold for receiving the pressurized air from said manifold, and a nozzle attached to said hose; and a control valve device including a barrel connected to said manifold, said barrel including a chamber formed within said barrel for receiving the pressurized air from said manifold, said barrel including a first outlet port and a second outlet port communicating with said chamber of said barrel, said pressure gauge being connected to said first outlet port of said barrel for displaying a pressure in said chamber of said barrel, said hose being coupled to said second outlet port of said barrel for receiving the pressurized air from said barrel, a nozzle being attached to said hose, and a valve member slidably received and engaged in said chamber of said barrel, said valve member including a pathway communicating with said chamber of said barrel for aligning with said second outlet port of said barrel, and for offsetting from said second outlet port of said barrel, and for controlling the pressurized air to flow from said chamber of said barrel into said second outlet port of said barrel.

2. The hand pump as claimed in claim 1, wherein said cover includes a bore for slidably engaging with said piston rod.

3. The hand pump as claimed in claim 1, wherein said control valve device includes an air storage tank having a mouth connected to said barrel and communicating with said chamber of said barrel for allowing the pressurized air to flow into and out of said air storage tank and to flow between said barrel and said air storage tank selectively.

4. The hand pump as claimed in claim 1, wherein said barrel includes a mouth engaged with said stud of said manifold.

5. The hand pump as claimed in claim 1, wherein said control valve device includes a spring biasing member disposed in said chamber of said barrel and engaged with said valve member for biasing and forcing said valve member to move relative to said barrel.

6. The hand pump as claimed in claim 1, wherein said control valve device includes an actuating shank having a cam member for engaging with said valve member and for moving said valve member relative to said barrel selectively.

7. The hand pump as claimed in claim 6, wherein said control valve device includes a housing attached to said barrel, and said housing includes a bore formed in said housing and communicating with said chamber of said barrel for rotatably receiving said actuating shank.

8. The hand pump as claimed in claim 6, wherein said housing is formed integral with barrel and perpendicular to said barrel.

9. The hand pump as claimed in claim 6, wherein said control valve device includes a hand grip attached to said actuating shank for rotating said actuating shank relative to said housing and for controlling said valve member to move relative to said barrel selectively.

10. The hand pump as claimed in claim 1, wherein said receptacle includes a passage formed in said bottom portion of said receptacle and communicating with said compartment of said receptacle, a gasket is engaged into said compartment of said receptacle and includes an orifice formed in said gasket and aligned with said passage of said receptacle for engaging with said check valve.

* * * * *